United States Patent [19]

Herman

[11] 4,252,135

[45] Feb. 24, 1981

[54] SMOKING APPARATUS

[76] Inventor: John Herman, 3060 Belden Dr., Los Angeles, Calif. 90068

[21] Appl. No.: 108,946

[22] Filed: Dec. 31, 1979

[51] Int. Cl.[3] ..... A24F 3/00

[52] U.S. Cl. ..... 131/180; 131/176; 131/221; 131/194

[58] Field of Search ..... 131/176, 178, 180, 181, 131/221, 222, 194, 226

[56] References Cited

U.S. PATENT DOCUMENTS

| | | | |
|---|---|---|---|
| 154,954 | 9/1874 | MacKintosh | 131/221 X |
| 373,258 | 11/1887 | Werner | 131/222 X |
| 1,232,310 | 7/1917 | Hoefler | 131/180 |
| 3,872,872 | 3/1975 | Kahler | 131/221 X |

*Primary Examiner*—Stephen C. Pellegrino
*Attorney, Agent, or Firm*—George J. Netter

[57] ABSTRACT

A smoking pipe having a rectangular, metal bowl with a cylindrical bore within which is received an insert having at opposite ends concavities of differing volumes such that either a small or a large bowl cavity is provided for receipt of smoking material. The opposite end or bottom of the bore includes a threaded member forming a removable bottom to the bore for cleaning purposes. The outer end of the stem includes a soft material annulus with beveled outer end portions. Immediately above the stem, a shallow opening is formed in the side wall of the bowl for releasably holding the end of a hollow container for smoking materials. A cover is pivotally located over the open bowl top.

5 Claims, 4 Drawing Figures

SMOKING APPARATUS

The present invention relates generally to smoking apparatus, and, more particularly, to smoking aparatus in the form of a smoking pipe having in combination therewith a variable volume smoking bowl and means for storing a quantity of smoking material.

SUMMARY OF THE INVENTION

There is provided in accordance with the practice of this invention, smoking apparatus in the general form of a smoking pipe having a generally rectangular, metal bowl with flat sides adapted for hand-held use. The bowl also includes a cylindrical bore within which is received an appropriately dimensioned insert having at opposite ends concavities of differing volumes whereby, depending upon the disposition of the insert within the bore, either a small or a large bowl cavity is provided for receipt of smoking material. The opposite end or bottom of the bore includes a threaded member forming a removable bottom to the bore for cleaning purposes.

An elongated hollow tubular element serving as a pipe stem is fittingly received in the bowl side wall in communication with the bore. The outer end of the stem includes a soft material annulus received thereon with a beveled outer end portion. Immediately above the stem, a shallow opening is formed in the side wall of the bowl for receiving the end of a hollow cylinder in releasable engagement therewith. This cylinder is a container within which smoking materials are stored. A cover is pivotally connected to the top of the bowl portion for selective location over or in covering relationship to the bore opening or uncovering relationship thereto. The two side walls of the bowl have relatively thin members of a good heat insulator adhered to the outer surface protecting the fingers of the smoker during smoking.

DESCRIPTION OF A PREFERRED EMBODIMENT

Figure 1:
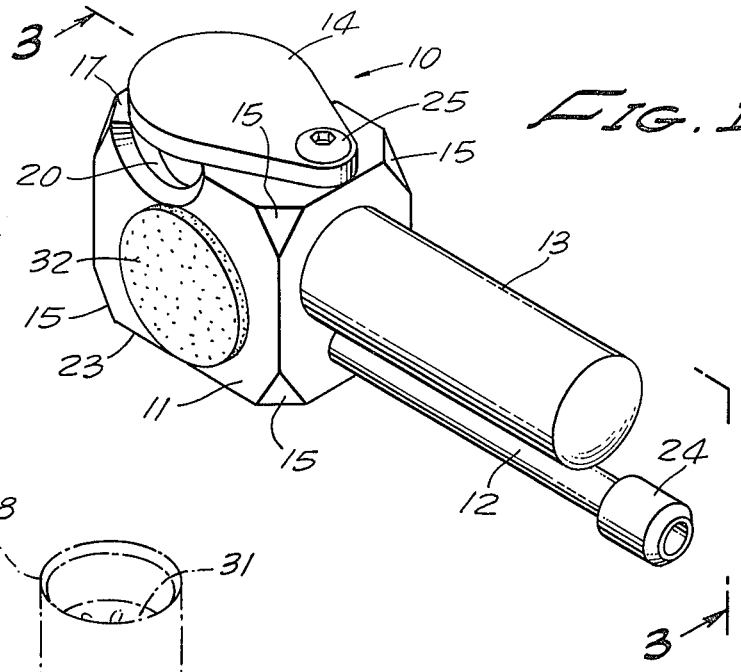
FIG. 1 is a perspective view of the smoking pipe apparatus of this invention.

With reference now to FIG. 1, the smoking apparatus or smoking pipe apparatus 10 of the present invention in its major aspects, is seen to include a smoking bowl 11, a stem 12 affixed to the bowl 11, and a storage chamber 13 also affixed to the bowl 11 and extending generally in the same direction as the stem 12. A cover 14 is selectively positionable over the bowl opening or leaving it exposed, as desired.

Figure 2:
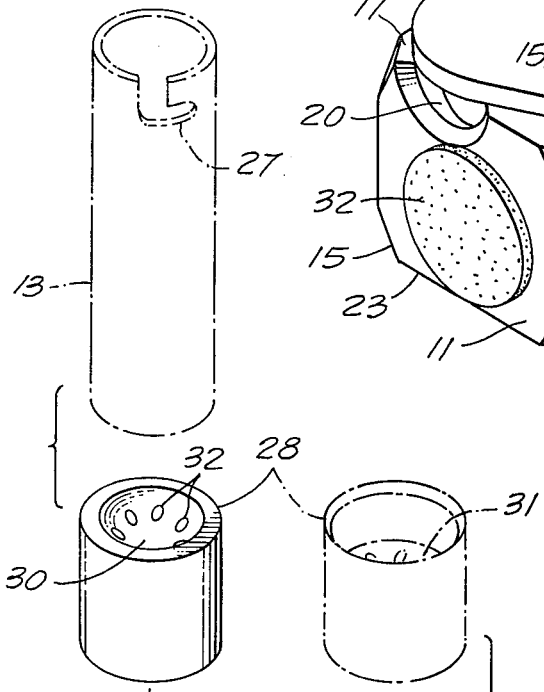
FIG. 2 is an exploded view of the smoking pipe apparatus of FIG. 1 showing the various parts in disassembled form.
Figure 2:
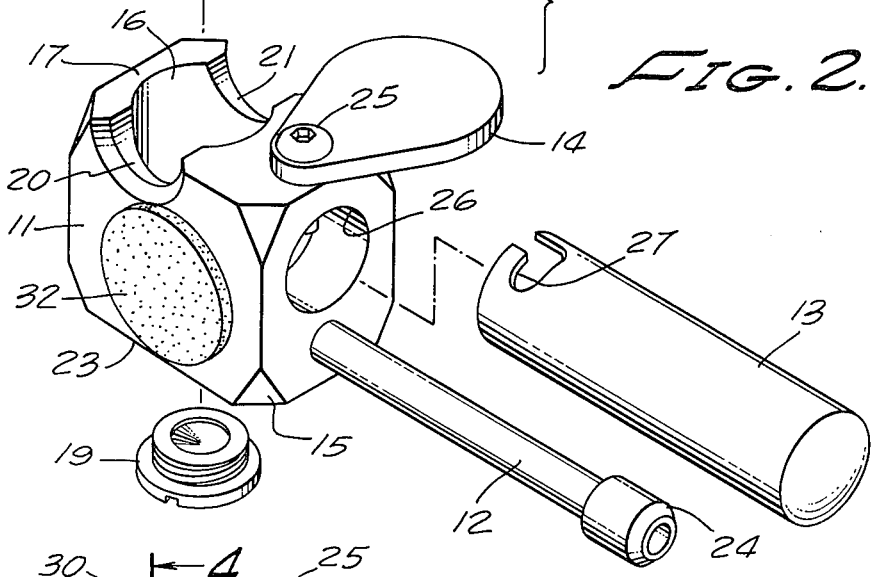
Figure 3:
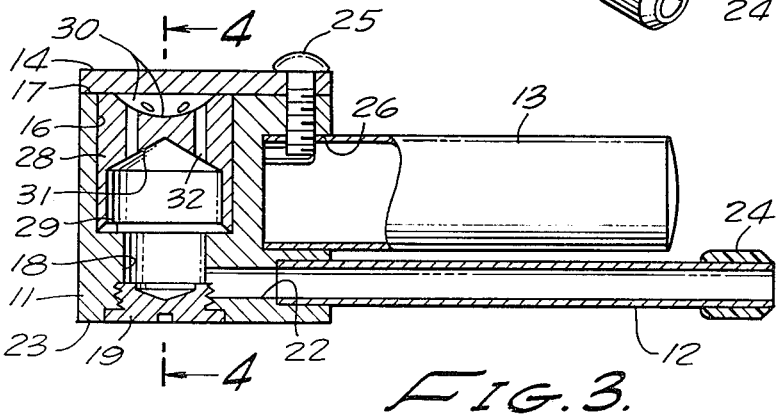
FIG. 3 is a side elevational, partially sectional view taken along the line 3—3 of FIG. 1.
Figure 4:
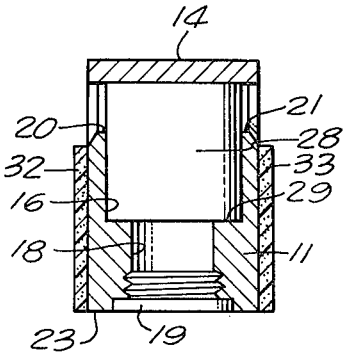
FIG. 4 is an end elevational sectional view taken along the line 4—4 through the pipe bowl in FIG. 3.

With reference now simultaneously to FIGS. 2–4, the pipe bowl 11 is constructed of a one-piece, generally rectangular parallelepiped metal block with each of the corners flattened off as at 15, for example, the latter to prevent accidental injury to the user or others from the sharp corners. A first cylindrical bore opening 16 extends from the top outer wall surfaces 17 of the bowl through slightly more than one-half of the bowl body with a second opening 18 of smaller diameter aligned with 17 extending through the remaining body of the bowl 17 (FIG. 3). A threaded plug 19 is received within similarly threaded portions of the opening 18, and is so dimensioned and of such geometry that when fully received within the opening the outer surface is flush with the lower surface of the bowl 11.

Two opposed side walls defining the opening 16 have portions removed at the upper surface 17 to form first and second generally semi-cylindrical openings 20 and 21 which extend completely through the body wall of the bowl and providing communication between the bore 16 and the exterior. A further opening 22 is formed in the bowl closely adjacent the lower wall 23 and extending transversely of the opening 16. The hollow, elongated, cylindrical tube 12 which forms the stem for the pipe, is fittingly received within the opening 22 and has at its outermost end a slightly larger diameter mouthpiece or bit 24. Preferably, the bit 24 is a relatively soft material such as plastic, which the smoker can bite into without running the risk of damaging his teeth.

The cover 14 is a flat, platelike member preferably made of metal and pivotally secured to the top surface 17 of the bowl 11 via threaded means 25. The cover is of an oblong, somewhat tear-drop shape which permits its being adjusted to substantially completely cover the opening 16 (FIG. 1), to be completely free of the opening 16 (FIG. 2), or any intermediate position. It is to be noted that when the cover 14 is fully in place over the opening 16 and closing it as in FIG. 1, for example, the side openings 20 and 21 still provide a certain amount of access for external air to the bowl interior.

Just above the opening 22 within which the stem 12 is received, there is formed a shallow opening 26 of a diameter permitting fitting receipt of an end portion of container 13 therewithin. As can be seen best in FIG. 3, the inner end of the threaded means 25 extends a limited amount into the opening 26 for cooperative engagement with a hook-shaped opening 27 in the open end of the container 13. More particularly, the container 13 can be inserted into the opening 26 with the end of the threaded means 25 passing into the hook-shaped opening 27 and the container on being rotated about its longitudinal axis (clockwise in FIG. 2) a slight amount becomes lockingly engaged via the threaded means within the opening 26. Release of the container is effected simply by rotating the container in the reverse direction (counterclockwise in FIG. 2) and withdrawing from the bowl opening.

A cylindrical insert 28 is of such diameter as to enable sliding receipt within the bowl opening 16 and when its inner end rests on the shoulder 29, the upper end is coextensive with the bowl upper surface 17. In this manner, when the insert is in place within the opening 16, closing the cover 14 serves to hold the insert securely within the opening without any up and down sliding movement of the insert.

The cylindrical insert 28 has one end formed into a relatively small concavity 30 and its opposite end into a relatively deep concavity 31 with a plurality of openings 32 extending through the wall separating the two. These concavities serve as the actual bowl within which smoking materials reside during use.

A pair of pads 32 and 33 made of a good heat insulator (e.g., cork, felt) are cemented to the opposite sides of bowl 11 and serve as protection for the fingers against burning. That is, in use the metal insert and bowl will normally become quite hot making the pipe uncomfortable to hold without the protection afforded by the pads.

In a still further aspect, the diameter of the container 13 is no greater than that of the concavities 30 and 31 so that the container closed end can be used to tamp down smoking materials in 30 and 31 (dash line depiction in FIG. 2).

In the practice of this invention, there is provided smoking pipe apparatus having a bowl 11 within which is releasably located an insert 28 having two concavities of substantially different volumes. That is, if the user wishes a relatively short smoke, then the insert is positioned in the bowl opening 16 with the concavity 30 uppermost, whereas if a longer smoke is desired the insert is reversed to have the larger concavity 31 face upwardly. To clean the pipe apparatus, the insert 19 may be removed from the bowl and the plug 19 unthreaded permitting individual and thorough cleaning of the various parts.

I claim:

1. Smoking pipe apparatus, comprising in combination:

bowl means including an insert slidably received therein, said insert having a first relatively small concavity and a second relatively large concavity with said insert being selectively positionable to expose one of the concavities for receiving smoking materials;

hollow stem means affixed to the bowl means and in communication with the insert concavities; and a hollow tubular container having a closed end and an open end, the open end being releasably engaged within a first opening in the bowl means.

2. Smoking pipe apparatus as in claim 1, in which the bowl means includes a second opening through one surface within which the insert is received and a plate-like cover is pivotally secured to said bowl means for movement over said second opening and remote therefrom.

3. Smoking pipe apparatus as in claim 2, in which said cover is pivotally affixed to the bowl means by a threaded member having an inner end received within said bowl means second opening, said threaded means inner end being received in an opening in the container open end portion for releasably securing the container therein.

4. Smoking pipe apparatus as in claim 1, in which first and second heat insulating pads are affixed to opposed sides of the bowl means.

5. Smoking pipe apparatus as in claim 2, in which a plug is removably secured to the bowl means in a further opening therein which is in communication with the second opening.

* * * * *